United States Patent [19]

Roy et al.

[11] Patent Number: 4,739,361

[45] Date of Patent: Apr. 19, 1988

[54] ROLLER TRANSFER APPARATUS

[75] Inventors: Carl W. Roy, Spencerport; Brian J. Joseph, Rochester; Robert M. Peffer, Penfield, all of N.Y.

[73] Assignee: Eastman Kodak Company, Rochester, N.Y.

[21] Appl. No.: 939,828

[22] Filed: Dec. 9, 1986

[51] Int. Cl.[4] ..... G03G 15/00

[52] U.S. Cl. ..... 355/3 TR; 355/3 DD; 355/73

[58] Field of Search ..... 355/3 DR, 3 TR, 73, 355/76; 101/415.1

[56] References Cited

U.S. PATENT DOCUMENTS

| | | | |
|---|---|---|---|
| 3,640,249 | 2/1972 | Young . | |
| 3,847,478 | 11/1974 | Young | 355/3 R |
| 3,924,943 | 12/1975 | Fletcher | 355/3 R |
| 4,179,211 | 12/1979 | Kimura et al. | 355/3 DR |
| 4,403,847 | 9/1983 | Chrestensen | 355/3 TR |
| 4,550,999 | 11/1985 | Anderson | 355/3 TR |

*Primary Examiner*—William H. Beha, Jr.

*Attorney, Agent, or Firm*—Lawrence P. Kessler

[57] ABSTRACT

A transfer roller apparatus for use for example in an electrographic copier including a dielectric member adapted to carry electrostatically developed marking particle images, and the mechanism for applying an electrical bias thereto. The transfer roller apparatus, employing a mechanism for accurately locating a receiver member on the periphery of the roller, dielectric member of the copier. Such apparatus includes a conductive core, mounted for rotation about its longitudinal axis and located such that its peripheral surface is in operative relation with the dielectric member. An electrical bias is applied to the roller to establish a transfer field between the roller and the dielectric member to effect transfer of marking particle images from the dielectric member to a receiver member accurately located on the peripheral surface of the roller. The bias is applied by connecting an electrical potential source to the roller through the conductive core. A discontinuity in the transfer field is created in the area of the roller surface over which located and tacking of a receiver member are effected.

7 Claims, 5 Drawing Sheets

FIG. 1
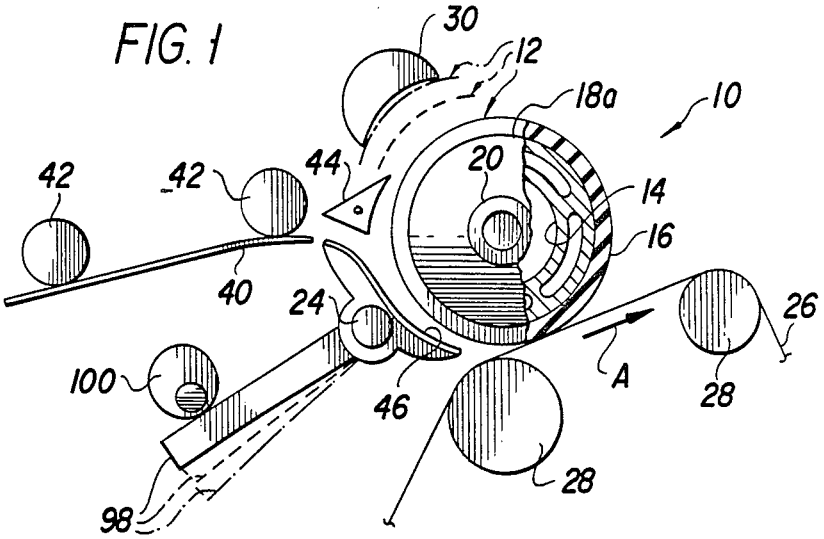
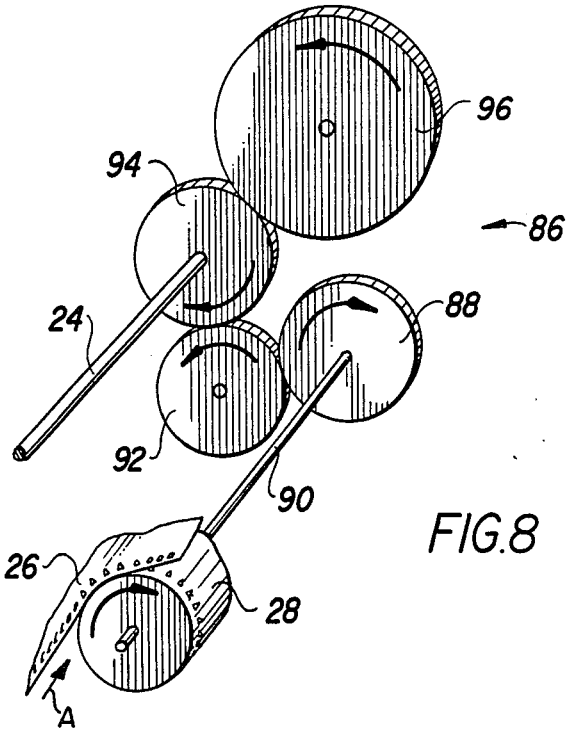
FIG.8

ROLLER TRANSFER APPARATUS

RELATED APPLICATIONS

This application is related to U.S. patent application Ser. No. 939,827, entitled ROLLER TRANSFER APPARATUS, filed Dec. 9, 1986, in the name of Roy et al; and Ser. No. 839,840, entitled ROLLER TRANSFER APPARATUS, filed Dec. 9, 1986, in the name of Roy.

BACKGROUND OF THE INVENTION

This invention relates in general to a transfer apparatus for use for example in an electrographic copier, and more specifically to a roller transfer apparatus of particular construction and the mechanism for applying an electrical bias thereto.

In typical electrographic reproduction apparatus (copiers or copier/duplicators), marking particles are attracted to a latent image charge pattern formed on a dielectric support to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member, or by supporting the receiver member on an electrically biased roller holding the receiver member against the dielectric support. While roller transfer apparatus are inherently more complex than corona transfer apparatus, roller transfer apparatus offer certain advantages. For example, roller transfer apparatus typically require a lower energy budget, and also maintain a more positive (physical) control over the receiver member. This positive control is particularly desirable when a receiver member must be recirculated to have multiple images transferred thereto, such as in making multicolor reproductions.

Positive control over the receiver member on the transfer roller has heretofore been provided by mechanical grippers or vacuum mechanisms. Mechanical grippers, such as shown in U.S. Pat. No. 3,612,667 (issued Oct. 12, 1971, in the name of Langdon et al) are of complex construction. For example, the grippers must be recessible within the periphery of the transfer roller to prevent their contacting the dielectric member and causing damage thereto. Vacuum tacking mechanisms are, on the other hand of a much more simple construction (see for example, U.S. Pat. No. 3,633,543, issued Jan. 11, 1972, in the name of Pitasi et al). However, in vacuum tacking of a receiver member to the transfer roller, control over the location of the lead edge of the receiver member for accurate registration of the marking particle images on the dielectric member to the receiver member is not as precisely effectable as with mechanical grippers. Any misregistration may result in the reproduction on such receiver member being of unacceptable quality. Moreover, electrostatic forces of the transfer field generated by the electrical bias applied to the transfer roller tend to attract the receiver member to the dielectric member (that is, the electrostatic forces tend to act in opposition to the vacuum tacking forces.

These opposing forces create the potential for preventing accurate tacking of the receiver member to the transfer roller from taking place resulting in undesirable copier stoppages.

SUMMARY OF THE INVENTION

This invention is directed to a transfer roller apparatus for use for example in an electrographic copier including a dielectric member adapted to carry electrostatically developed marking particle images, and the mechanism for applying an electrical bias thereto. The transfer roller apparatus, employing a mechanism for accurately locating a receiver member on the periphery of the roller, includes a cylindrical roller, including a coaxial conductive core, mounted for rotation about its longitudinal axis and located such that its peripheral surface is in operative relation with the dielectric member. An electrical bias is applied to the roller to establish a transfer field between the roller and the dielectric member to effect transfer of marking particle images from the dielectric member to a receiver member accurately located on the peripheral surface of the roller. The bias is applied by connecting an electrical potential source to the roller through the conductive core. A discontinuity in the transfer field is created in the area of the roller surface over which locating and tacking of a receiver member are effected.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1 is an end elevational view of the transfer apparatus according to this invention, with a portion broken away to facilitate viewing;

FIG. 8 is a view, in perspective, of the gear train for rotatably driving the transfer roller of FIG. 1;

DESCRIPTION OF THE PREFERRED EMBODIMENTS

Figure 2:
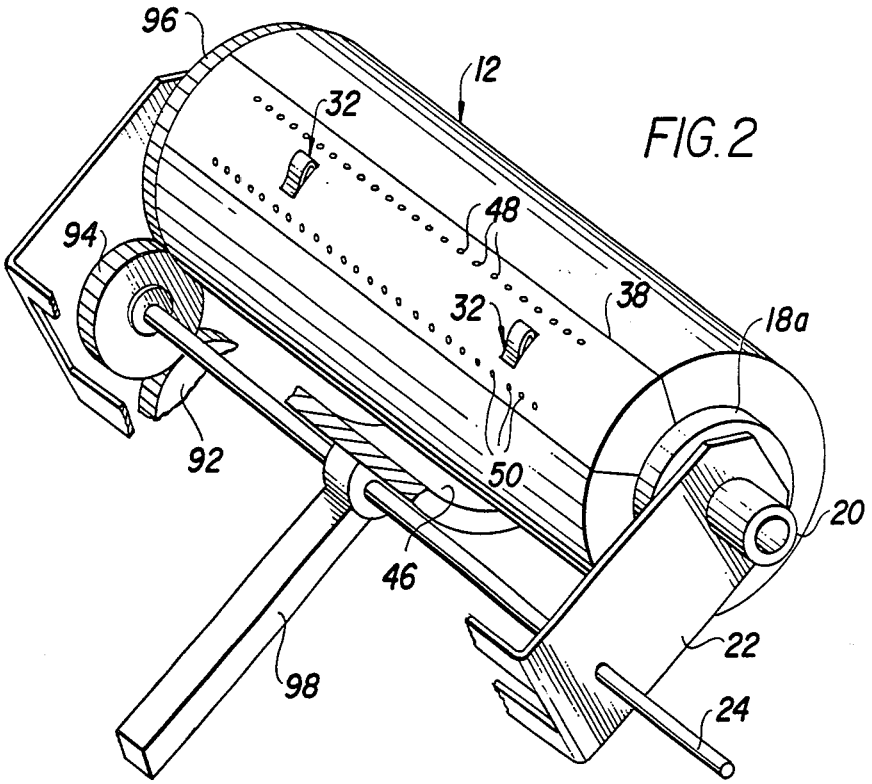
FIG. 2 is a view, in perspective, of the transfer apparatus of FIG. 1, particularly showing the mounting structure thereof.

Referring now to the accompanying drawings, FIG. 1 shows a transfer apparatus, according to this invention, designated generally by the numeral 10. The transfer apparatus 10 includes a cylindrical roller 12 comprising a conductive core 14 having a surface layer 16 formed thereon. The surface layer 16, which may be of an insulating, semi-insulating, or conductive material for example, is tailored to yield optimum production of an electric transfer field for effecting transfer of a marking particle image from a dielectric image-carrying member to a receiver member supported on such surface layer. The core 14 is coupled to end gudgeons 18*a*, 18*b* which have integrally formed stub shafts 20 (only one shown in FIG. 1) extending therefrom coaxially with the longitudinal axis of the roller 12. As shown in FIG. 2, the shafts 20 are mounted in a frame 22 for free rotation about their longitudinal axes.

The frame 22 is, in turn, supported on, and keyed to, an elongated shaft 24. Rotation of the shaft 24 serves to pivot the frame 22 for articulating the roller 12 in a manner which will be explained in more detail hereinbelow. Articulation of the roller 12 effects selective movement thereof to a plurality of desired positions. In the first position of the roller 12 (shown in solid lines in FIG. 1), the peripheral surface layer 16 of the roller is in operative transfer association with a dielectric member 26. The dielectric member 26, supported for movement in the direction of arrow A about rollers 28, is adapted to carry electrostatically developed marking particle images in sequential image areas of the member. Formation of such images in the sequential image areas of the dielectric member may be accomplished by any well known technique, such as electrographically for example. With an electrical transfer field applied between the roller 12 and the dielectric member 26, the marking particle images are transferred from the dielectric member to a receiver member supported on the peripheral surface of the roller 12. In its second position (dot/dash line of FIG. 1), the roller 12 is operatively engaged with a roller cleaning mechanism 30. The cleaning mechanism 30 wipes the peripheral surface of the roller 12 to remove any marking particles which are deposited on the surface. In the third position (broken line of FIG. 1), the roller 12 is located at an intermediate location out of operative relation with both the dielectric member 26 and the cleaning mechanism 30. Such intermediate position prevents any potential damage to the roller, cleaning mechanism, or the dielectric member by their being left in contact during an extend period of time when transfer or cleaning is not being accomplished.

In order to carry out accurate transfer of marking particle images to receiver members, a receiver member must be accurately located on the peripheral surface of the transfer roller 12, and the angular position of the roller (and the receiver member located thereon) must be accurately related to the location of the marking particle image on the dielectric member. Such accurate location is especially necessary when a plurality of marking particle images are to be transferred to a receiver member in superimposed register, as in forming a multi-color reproduction. Accurate location of a receiver member on the peripheral surface 16 of the roller 12 is accomplished by a pair of flexible locating members 32.

Figure 3:
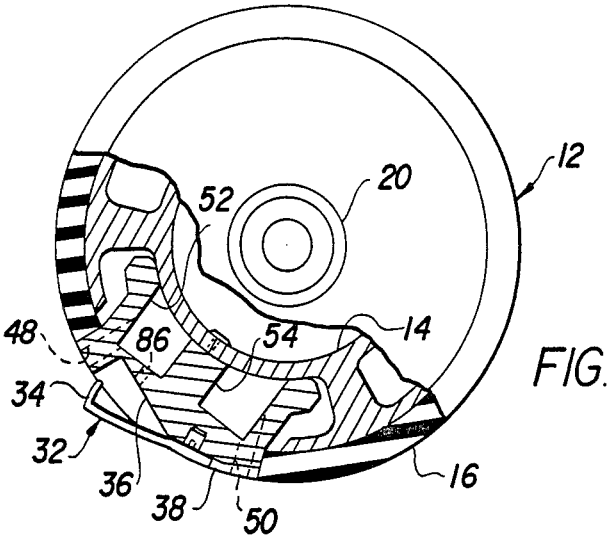
FIG. 3 is an end elevational view, partly in cross-section, of the transfer roller according to this invention, particularly showing the receiver member locating mechanism in its first position.
Figure 4:
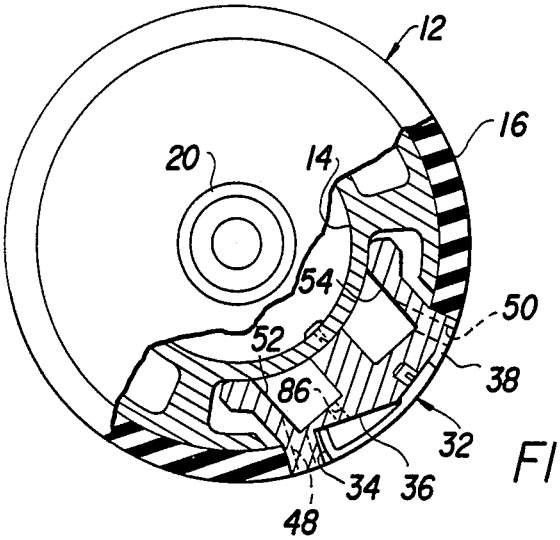
FIG. 4 is an end elevational view, similar to FIG. 3, showing the receiver member locating mechanism in its second position.

As shown in FIGS. 2–4, the flexible locating members 32 are secured to the surface 16 of the transfer roller 12 at spaced locations along an element thereof. The flexible members 32 each have a receiver member locating feature 34 integrally formed at one end, the respective features being aligned with each other to align the lead edge of a receiver member on the surface of the roller 12. Of course, any desired number of flexible members may be utilized with this invention. The construction of the flexible members 32 is such that the locating feature normally extends above the peripheral surface 16 of the roller 12 (see FIG. 3). A cavity 36 formed in an insert 38 mounted in the roller 12 is positioned below the feature 34. The cavity 36 is adapted to receive the feature when the flexible member 32 (and thus the feature) is urged radially inwardly with respect to the roller as the roller rotates to bring the insert 38 into opposed relation with the dielectric member 26. When the flexible member is received within the cavity, its outermost surface is coincident with, or below, the peripheral surface 16 of the roller 12.

A receiver member is transported toward the transfer apparatus 10 along a guide plate 40 by any well known transport mechanism, such as rotating scuff rollers 42. A deflector 44 and a guide 46 cooperate to direct the lead edge of a transported receiver member into engagement with the transfer roller 12 upstream of the transfer zone formed by the nip between the roller and the dielectric member. The roller 12 is angularly positioned, in the manner to be described hereinbelow, to locate the flexible members 32 for engagement of the transported receiver member with the features 34 as the receiver member engages the roller. The linear velocity for the transported receiver member is selected to be somewhat greater than linear velocity of the roller surface 16 so that the receiver member is over driven into the features 34. This insures that the lead edge of the receiver member is accurately engaged with the features.

The receiver member, located by the features of the flexible members 32, is retained in its accurate location on the peripheral surface 16 of the transfer roller 12 by vacuum tacking of the lead and trail edges of such receiver member to the peripheral surface. To effect such vacuum tacking, the transfer roller 12 includes a first series of ports 48 and a second series of ports 50. The first series of ports 48 is defined by, and extends through, the insert 38 along a segment of the roller 12 immediately up stream of the features 34; and, the second series of ports 50 is defined by, and extends through, the insert along a segment of the roller immediately downstream of the flexible members 32. The insert 38 further defines a pair of elongated chambers 52, 54, which are in flow communication with the first and second series of ports respectively.

Figure 5:
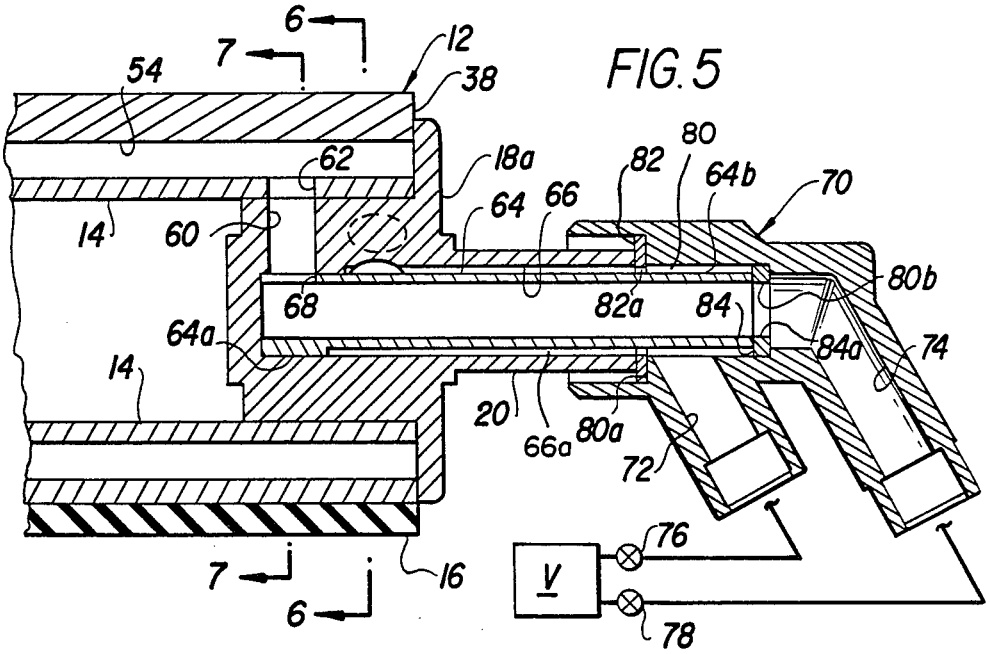
FIG. 5 is a side elevational view, in cross-section, of a portion of the transfer roller particularly showing the vacuum connection thereto.
Figure 7:
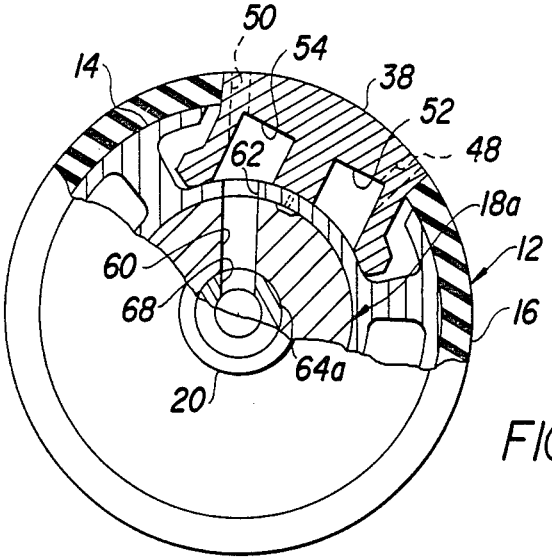
FIG. 7 is an end elevational view, in cross-section, of the transfer roller of FIG. 5 taken along lines 7—7.
Figure 6:
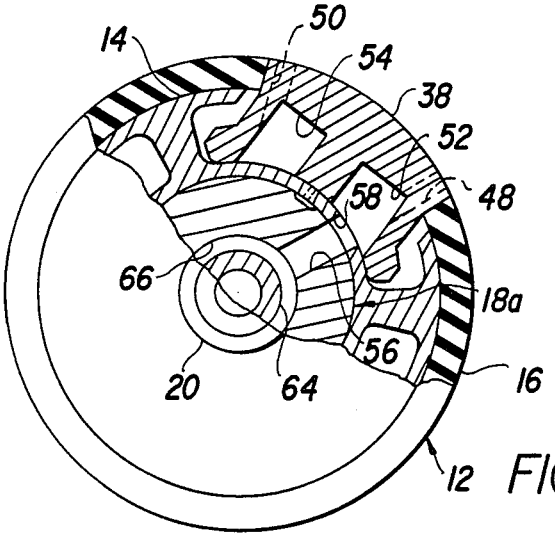
FIG. 6 is an end view, in cross-section, of the transfer roller of FIG. 5 taken along lines 6—6.

As best shown in FIGS. 5–7, the end gudgeon 18*a* is particularly constructed to enable the chambers 52, 54, of the insert 38 to be respectively selectively connected to a vacuum source V. The gudgeon has a first radial port 56 in flow communication with a port 58 in the core 14 to provide flow communication to the chamber 52, and a second radial port 60 in flow communication with a port 62 in the insert 38 to provide flow communication to the chamber 54. A hollow tube 64 is coaxially disposed within an elongated passage 66 defined in the gudgeon and its stub shaft 20, and extends outwardly of the stub shaft. The passage 66 is configured so as to sealingly receive one end 64*a* of the tube 64 and provide an annular chamber 66*a* between the remainder of the tube and the passage. The end 64*a* of the tube 64 has a port 68 defined therein and extending therethrough to provide flow communication from the port 60 to the interior of the tube.

A dual flow coupling 70 is supported for relative rotation on the end 64*b* of the tube 64. The coupling has first and second passages 72, 74 which communicate through respective independently controlled valves 76, 78, with the vacuum source V. A third passage 80, provided in the coupling 70, is configured to receive the stub shaft 20 and the end 64*b* of the tube 64. The passage 80 has a first land 80*a* supporting an annular seal bearing 82, and a second land 80*b* supporting an annular seal bearing 84. The end of the stub shaft 20 seats on the seal bearing 82, while the end of the tube 64 seats on the seal bearing 84. The end gudgeon 18 and the tube 64 can then rotate (with the roller 12) relative to the coupling 70 without adversely effecting the interconnection to the vacuum source V. The bore 82*a* in the seal bearing 82 is dimensioned to limit flow communication to between passage 72 and the annular chamber 66*a* between tube 64 and the passage 66, while the bore 84*a* in the seal bearing 84 is dimensioned to limit flow communication to between passage 74 and the interior of the tube 64. Accordingly, the vacuum source V, by selective operation of the valves 76, 78, is connected to the first and second series of ports 48, 50, to effect tacking of the lead and trail edges of a receiver member to the peripheral surface 16 of the transfer roller 12 when the lead and trail edges of the receiver member come into operative association with such ports respectively. The timing of operation of the valve 76 is selected such that vacuum source V is connected to the ports 48 after a receiver member is located by the features 34. As such the vacuum is prevented from prematurely tacking the receiver member lead edge to the surface 16 (i.e., before it is fully located).

The insert 38 may additionally define ports 86 communicating between the cavities 36 and the chamber 52. While only one such port arrangement is shown in FIGS. 3 and 4, it is of course understood that each cavity has a substantially identical port arrangement. When the flexible members 32 are in their first (receiver member locating) position, the port 86 vents the chamber 52 to atmosphere. The timing of operation of the valve 76 is then no longer of critical importance because the vacuum from source V is prevented from being effective through ports 48 to tack the lead edge of the receiver member to the peripheral surface of the roller 12. Such lead edge can then accurately align with the features 34 without being adversely effected, such as by premature tacking to the surface 16. Moreover, after the receiver member has been located by the features 34 and when the flexible members 32 are urged to their second position (coincident with the peripheral surface of the roller), the features seal the cavity 36. This results in the vacuum from source V being effective through the ports 48 to tack the lead edge of the receiver member to the roller surface. Additionally, the vacuum acts to retain the flexible members in such second position.

As noted above, it is essential that the angular position of the roller (and the receiver member located thereon) be accurately related to the location of the marking particle images on the dielectric member. Accordingly, the circumferential dimension of the transfer roller 12 is selected to be substantially equal to the distance between corresponding points in successive image areas on the dielectric member 26. Then, if the angular velocity of the roller 12 is such that the linear velocity of the surface 16 of the roller is substantially equal to the linear velocity of the dielectric member, and the location of the lead edge of a receiver member (as established by the features 34) is related to the lead edge of an image area, the movement of the roller and the dielectric member can be synchronized to insure accurate transfer of a marking particle image in register to the receiver member, or accurate transfer of successive marking particle images in superimposed register to the receiver member.

The synchronization of rotation of the roller 12 with the movement of the dielectric member is accomplished by the gear train 86 best shown in FIG. 8. The gear train 86 includes a first gear 88 mounted for rotation on the drive shaft 90 for one of the dielectric supporting rollers 28. Such roller has its teeth (not shown) in mesh with perforations along a marginal edge of the dielectric member 26 for moving the dielectric member at a predetermined linear velocity in the direction of arrow A. Therefore, the angular velocity of the gear 88 is equal to that of roller 28. The remainder of the gear train 86 includes a second gear 92 in mesh with a third gear 94, mounted for free rotation about shaft 24, in mesh with a fourth gear 96, coupled to one end gudgeon of the transfer roller 12. Thus, the drive for the dielectric member 26 is synchronously related to rotation of the roller 12. The diameters and pitches of the respective gears of the gear train 86 are selected to yield substantially equal linear velocities for the peripheral surface 16 of the roller 12 and the dielectric member 26 to provide the synchronous movement therebetween.

The above described gear train arrangement provides a further advantage for the transfer apparatus 10 of this invention. That is, the articulation of the roller 12 to its various positions (i.e., for transfer, cleaning, or intermediate thereof) may be accomplished without separating the roller drive from the dielectric member, thereby preventing losing the synchronous relation between the lead edge of an image area on the dielectric member and the positional location for the lead edge of a receiver member. To effect such articulation, an elongated arm 98 is coupled to the shaft 24. The arm 98 serves as a follower for a cam 100. The cam 100 is selectively rotated to move the arm 98 to impart rotation to the shaft 24. Such rotation of the shaft 24 articulates the frame 22, and thus the roller 12, for movement to one of the desired positions. Since the gear 24 is mounted for free rotation on the shaft 24, when the cam effects rotation of the shaft, the shaft rotates relative to such gear, and gear 96 walks about such gear to maintain their intermeshing relation. In this manner, the drive for the transfer roller 12 is never decoupled from the dielectric member 26.

Figure 9:
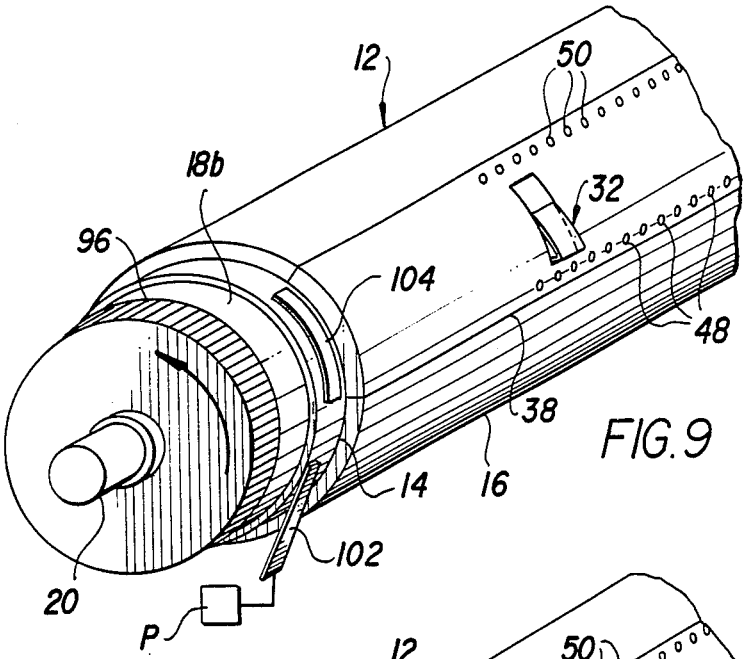
FIG. 9 is a view, in perspective, of a portion of the transfer roller of FIG. 1.

The construction of the transfer apparatus 10 according to this invention prevents failure of the location and tacking of a receiver member to the surface 16 of the transfer roller 12 due to the application of the transfer field over the area in which such tacking is to take place, as has sometimes occurred in prior transfer apparatus, by creating a discontinuity in the field over such area. The field is produced by electrically coupling the transfer roller 12 to an electric potential source P by contacting the conductive core 14 of the roller adjacent to the end gudgeon 18*b* with a conductive wiper 102 electrically connected to the potential source. In the embodiment of FIG. 9, the core 14 has an insulative member 104 secured to the peripheral surface thereof. The insulative member 104 subtends an arc substantially equal to a comparable arc subtended by the insert 38, spaced radially inwardly of the insert. Accordingly, when the wiper 102 contacts the insulative member 104, the application of electrical potential to the roller 12 is interrupted causing the transfer field to be removed.

Therefore, with the transfer field no longer being existent, there is no field to adversely effect receiver member locating and tacking. As soon as the insulative member 104 passes out of contact with the wiper 102, the electrical potential is reconnected to the roller and the transfer field is re-established to again provide for marking particle image transfer.

Figure 10:
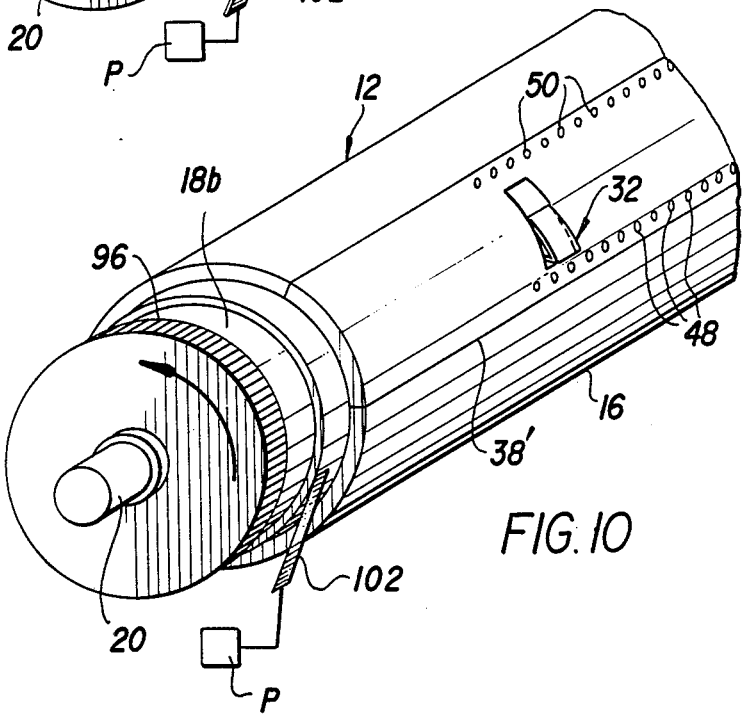
FIG. 10 is a view, in perspective, of a portion of an alternate construction of the transfer roller of FIG. 1.

It is, of course, obvious that the removal and re-establishment of the transfer field does not occur instantaneously. That is to say, on interruption of the electrical potential, there is a decay of the transfer field; and on reconnection of the electrical potential, the transfer field ramps up to its full effective level. Under certain circumstances, the field decay and ramp up characteristics may produce the same adverse effects on receiver member locating and tacking as described above. The embodiment shown in FIG. 10 overcomes the effects of field decay and ramp up by making the insert 38' of an insulative material and deleting the insulative member 104 of the embodiment of FIG. 9. Accordingly, the electrical potential source is constantly coupled to the roller 12 by wiper 102 through the core 14 so that field removal and re-establishment does not occur. However, since the insert 38' is an insulator, no field will exist in the area of the insert. Therefore, locating and tacking of the receiver member will not be adversely effected.

The invention has been described in detail with particular reference to preferred embodiments thereof, but it will be understood that variations and modifications can be effected within the spirit and scope of the invention.

We claim:

1. Transfer apparatus for use in a reproduction device including a dielectric member adapted to carry transferable marking particle images, said transfer apparatus comprising:

a substantially cylindrical roller including a conductive core;

means for mounting said roller for rotation about its longitudinal axis and locating said roller whereby its peripheral surface is in operative relation with said dielectric member;

means, associated with said roller, for accurately locating a receiver member on the peripheral surface of said roller; and means for applying an electrical bias to said roller to establish an electric transfer field between said roller and said dielectric member, said bias applying means including an electrical potential source, means for connecting said source to said roller through said conductive core, and means for providing a discontinuity in the transfer field in the area of the peripheral surface of said roller over which said locating means is effective to prevent such transfer field from interferring with locating and tacking of a receiver member to such surface.

2. The invention of claim 1 wherein said locating means includes positioning means, said positioning means being movable to a first position above such peripheral surface for effecting receiver member registration and to a second position at least coincident with such peripheral surface to prevent damage to said dielectric member as such means moves in opposed relation thereto, and means for vacuum tacking at least the lead marginal edge of a located receiver member to the peripheral surface of said roller.

3. The invention of claim 1 wherein said discontinuity providing means includes an insulator attached to said core for interrupting electrical bias applied from said source to said core, the location of said insulator on said core subtending an arc radially inward of a comparable arc subtended by a portion of the peripheral surface of said roller in which said locating means and said tacking means are contained.

4. The invention of claim 1 wherein said discontinuity providing means includes an insulative insert in said roller, said insert extending parallel to the longitudinal axis of said roller and adapted to contain said locating means.

5. Transfer apparatus for use in a reproduction device including a dielectric member adapted to carry transferable marking particle images, said transfer apparatus comprising:

a substantially cylindrical roller including a coaxial conductive core;

means for mounting said roller for rotation about its longitudinal axis and locating said roller whereby its peripheral surface is in operative relation with said dielectric member;

means, associated with said roller, for accurately locating a receiver member on the peripheral surface of said roller, said locating means being movable to a first position above such peripheral surface for effecting receiver member registration and to a second position at least coincident with such peripheral surface to prevent damage to said dielectric member as such means moves in opposed relation thereto;

means for selectively vacuum tacking at least the lead marginal edge of a located receiver member to the peripheral surface of said roller; and means for applying an electrical bias to said roller to establish an electric transfer field between said roller and said dielectric member, said bias applying means including an electrical potential source, means for connecting said source to said roller through said conductive core, and means for providing a discontinuity in the transfer field in the area of the peripheral surface of said roller over which said locating and tacking means are effective to prevent such transfer field from interfering with locating and tacking of a receiver member to such surface.

6. The invention of claim 1 wherein said discontinuity providing means includes an insulator attached to said core for interrupting electrical bias applied from said source to said core, the location of said insulator on said core subtending an arc radially inward of a comparable arc subtended by a portion of the peripheral surface of said roller in which said locating means and said tacking means are contained.

7. The invention of claim 1 wherein said discontinuity providing means includes an insulative insert in said roller, said insert extending parallel to the longitudinal axis of said roller and adapted to contain said locating means and said tacking means.

* * * * *